United States Patent [19]

Sikina, Jr.

[11] Patent Number: 4,583,098

[45] Date of Patent: Apr. 15, 1986

[54] CIRCULARLY POLARIZED ANTENNA USING AXIAL SLOT AND SLANTED PARASITIC RADIATORS

[75] Inventor: Thomas V. Sikina, Jr., Moorestown, N.J.

[73] Assignee: RCA Corporation, Princeton, N.J.

[21] Appl. No.: 646,422

[22] Filed: Aug. 31, 1984

[51] Int. Cl.[4] ..... H01Q 13/18

[52] U.S. Cl. ..... 343/771

[58] Field of Search ..... 343/725, 729, 767, 770, 343/771

[56] References Cited

U.S. PATENT DOCUMENTS

| | | | |
|---|---|---|---|
| 2,946,055 | 7/1960 | Faflick | 343/727 |
| 2,972,147 | 2/1961 | Wilkinson | 343/767 |
| 2,981,947 | 4/1961 | Bazan | 343/767 |
| 3,340,534 | 9/1967 | Fee | 343/728 |
| 3,541,560 | 11/1970 | Lyon et al. | 343/756 |
| 4,021,815 | 5/1972 | Bogner | 343/727 |
| 4,129,871 | 12/1978 | Johns | 343/727 |
| 4,297,706 | 10/1981 | Nikolayuk | 343/771 |

OTHER PUBLICATIONS

Antennas by Kraus, published by McGraw-Hill Book Co., 1950 pp. 356-361.

Antenna Engineering Handbook, edited by Jasik, published by McGraw-Hill, 1970, p. 8-2.

*Primary Examiner*—Eli Lieberman

*Attorney, Agent, or Firm*—Joseph S. Tripoli; Robert L. Troike; William H. Meise

[57] ABSTRACT

A slotted-cylinder antenna especially adapted for television broadcasting use radiates a circularly-polarized pattern. Each radiating slot is associated with an elongated conductive parasitic radiator in close proximity to the slot for good power coupling therebetween. The parasitic radiator is almost but not quite parallel with the slot (preferably being at a six degree orientation with the slot), so that energy is coupled into the parasite and reradiated almost vertically polarized. The combination of the radiated field of the slot and reradiated field of the parasite is made circularly polarized by selection of that length of the parasite which gives the correct phase-shift.

12 Claims, 15 Drawing Figures

Fig. 3a
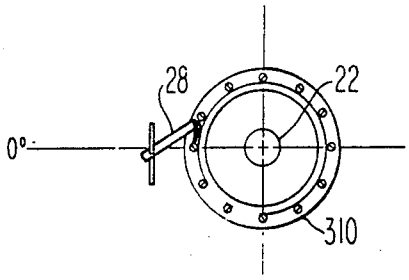
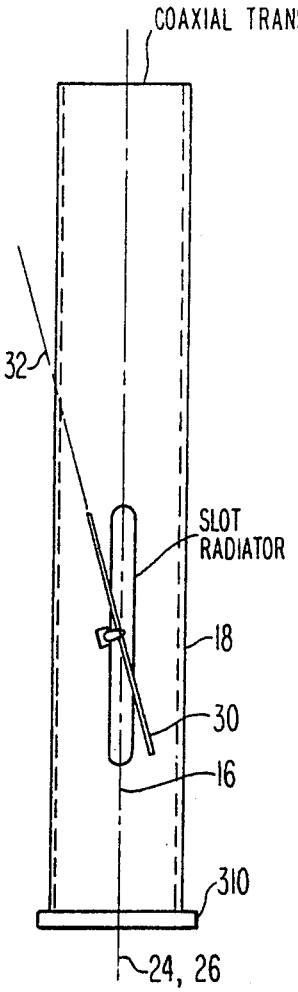
Fig. 3b
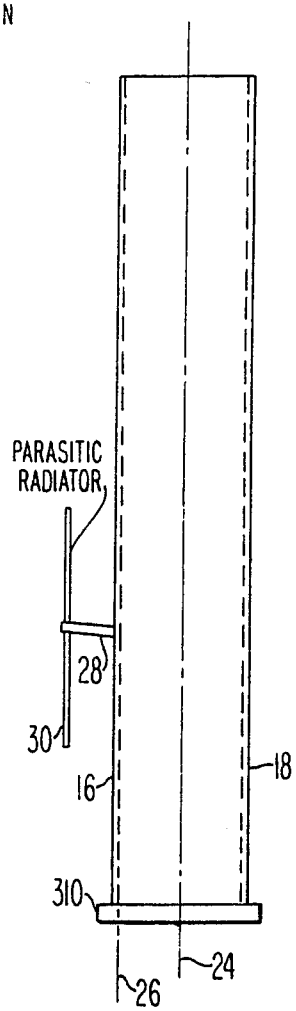
Fig. 3c

AZIMUTH PLANE

AZIMUTH PLANE

SOLID LINE-HORIZONTAL POLARIZATION
DASHED LINE-VERTICAL POLARIZATION

ELEVATION PLANE

AXIAL-RATIO PATTERN

ELEVATION PLANE

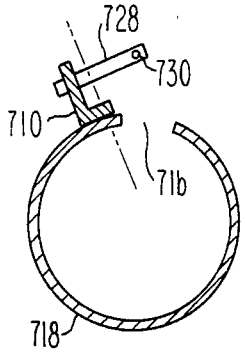
Fig. 7b
Fig. 7a
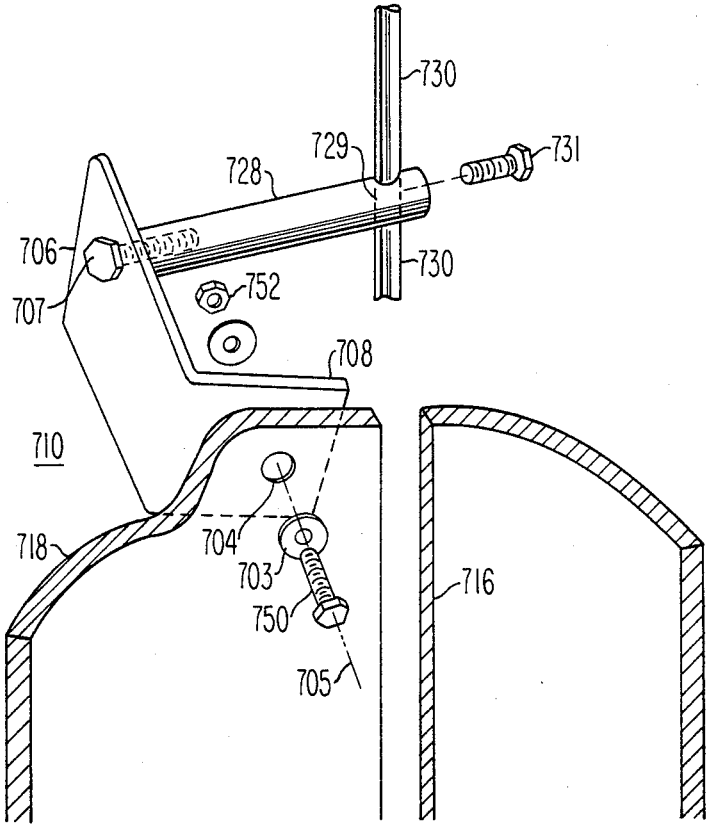

CIRCULARLY POLARIZED ANTENNA USING AXIAL SLOT AND SLANTED PARASITIC RADIATORS

This invention relates to antennas generally, and specifically to broadcast antennas for UHF applications which are of the slot-radiator or "pylon" type.

Television broadcast antennas are used to broadcast VHF or UHF television signals from a transmitter site to receivers within a geographic area. Generally, the television antenna is mounted on a tower or on a hill overlooking the area to which broadcasting is to be accomplished. In these locations, it is subject to extreme environmental conditions, such as high winds, ice loads, lightning and the like, and is also subject to heating and voltage effects due to high radio-frequency (RF) power. Specialized designs have evolved for producing the desired radiation pattern and polarization while maintaining ease of construction and assembly at the broadcasting site, low wind loading, high power handling capability, and low cost. In the UHF television frequency band of 470–830 MHz, the slot radiating or pylon antenna is popular. This type of antenna includes a cylindrical transmission line having a conductive outer surface. Such a transmission line may be a coaxial transmission line as described in U.S. Pat. No. 2,981,947 issued Apr. 25, 1961 to S. J. Bazan, or it my be a waveguide. The transmission line is mounted with its axis vertical. Elongated vertical slots are cut through the outer surface of the transmission line to form slot radiators. Each slot radiator has a predetermined radiation pattern. Additional slots may be cut around the periphery of the antenna to form an azimuthal array of radiators, and/or multiple bays of azimuthal arrays my be made by cutting further sets of slots at different longitudinal positions along the transmission line, in order to provide increased gain by a vertical array, thereby decreasing the elevation beam width in known fashion.

The far-field radiation pattern of a slot antenna as described above and in the aforementioned U.S. Pat. No. 2,981,947 is horizontally polarized. Attention has recently been directed to reducing the ghosts in a television display which result from signals arriving at the television receiver by two paths, one a direct path and one a reflective path. If the receiving antenna is circularly polarized it is strongly receptive to one hand or direction of circular polarization (that which is broadcast) and rejects the other hand of polarization. Television signals reflected by a conductive surface tend to experience a reversal of the hand polarization, so that the receiving antenna tends to reject the reflected signal, thereby reducing the ghosting. This system of ghost reduction, however, requires a circularly polarized transmitting antenna. As mentioned, a conventional pylon antenna is horizontally-polarized.

U.S. Pat. No. 4,021,815 to Bogner describes an antenna using horizontally-polarized slot radiators on a mast, an additional vertical mast, driven dipoles and directors to achieve circular polarization in an ominidirectional manner. This structure is complex, expensive to build and has substantial wind loading.

U.S. Pat. No. 4,297,706 issued Oct. 27, 1981 to N. Nikolayuk describes the use of radiating slots cut at orthogonal angles into the surface of a coaxial transmission line in order to produce circular polarization with very low wind loading. While the described arrangement is effective, it may be found to be difficult to make small adjustments to the axial ratio of the radiated circularly-polarized field, since the slots once cut into the surface are difficult to reposition. Therefore, the slots must be precisely cut, which adds to the cost of manufacture.

U.S. Pat. No. 4,129,871 issued Dec. 12, 1978 to Johns describes an antenna using vertical slots and an arrangement of pairs of driven folded conductors associated with each slot for generating a circularly-polarized radiation pattern. This arrangement has the disadvantage that the folds in the conductors are complex, cannot readily be adjusted for optimizing the field pattern, and the wind loading of the conductive elements is larger than may be desired.

U.S. Pat. No. 3,340,534 issued Sept. 5, 1967 to Fee describes slots in a waveguide with conductive loops skewed across the slots. This arrangement is very disdvantageous for a practical broadcast antenna, because the loops have a very low impedance, and at broadcast powers (which may be as high as 10 kW per slot) the loop currents become excessive, causing heating and burnout. Thus, an inexpensive pylon-type broadcast antenna is desired in which the polarization circularity may be readily adjusted, in which the slot position adjustment is not required, and which has low wind loading.

SUMMARY OF THE INVENTION

A pylon antenna includes a transmission-line having conductive outer conductor. An axial slot is cut through the outer conductor to form a slot radiator for generating horizontally polarized radiation. A straight linear parasitic radiator is mounted at a radial distance of approximately 1/10th wavelength outside the slot, with the axis of the parasitic element almost parallel with the axis of the transmission-line and the slot radiator, but deviating from a parallel condition by a small angle. In one embodiment, the angle is about 6°. By virtue of the proximity of the parasitic radiator to the slot, energy is coupled into the parasitic element and reradiated with almost vertical polarization. The horizontally-polarized slot radiation field and the vertically polarized component of the field reradiated by the parasitic radiator and re-reradiated by the mast interact in the far field to form an elliptically polarized radiation pattern with low axial ratio.

DESCRIPTION OF THE DRAWING

FIGS. 3*a* and 3*b* and 3*c* illustrate three orthogonal projections of a bay of an antenna in accordance with the invention;

FIGS. 7*a* and 7*b* illustrate details of a parasitic element mechanical mounting arrangement;

DESCRIPTION OF THE INVENTION

Figure 1:
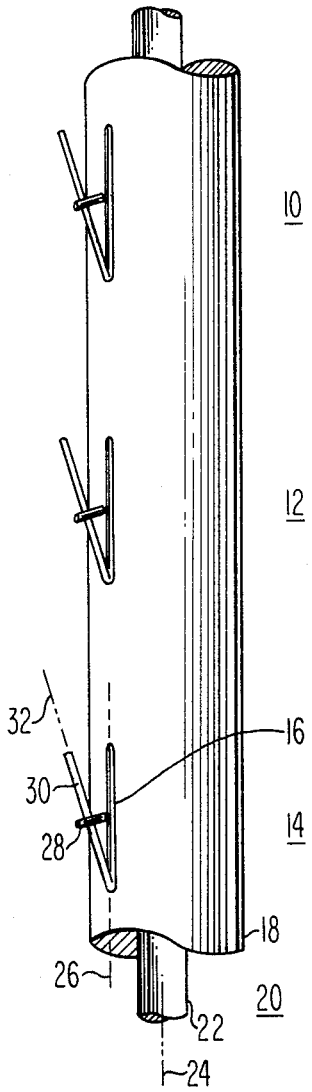
FIG. 1 illustrates a portion of a pylon antenna in accordance with the invention, including three vertically arrayed bays.

FIG. 1 illustrates three vertically arrayed bays 10, 12 and 14 of a UHF broadcast television antenna. The bays are identical, and are separated from each other by one wavelength (λ) at the frequency of operation as known in the art. Bay 14 is taken as typical, and includes an elongated vertically oriented slot 16 cut through an outer conductor 18 of a coaxial transmission line designated generally as 20 which includes a conductive center conductor 22 having the same axis 24 as outer conductor 18. Axial slot 16 is about one-half wavelength (λ/2) long at the frequency of operation, which corresponds to approximately 10 inches at 600 MHz. The longitudinal axis 26 of slot 16 is parallel to axis 24. A mechanical support 28 made from a nonconductive or dielectric material supports a thin elongated conductive rod 30 which has a length of about λ/2 at the operating frequency and a diameter less than one-tenth the length. The axis 32 of parasitic radiator 30 is not parallel to axes 24 or 26. Parasitic radiator 30 does not touch outer conductor 18 and is therefore galvanically isolated therefrom. Since elongated outer conductor 18 is oriented vertically, it is often referred to as "mast" or "pole".

Figure 2:
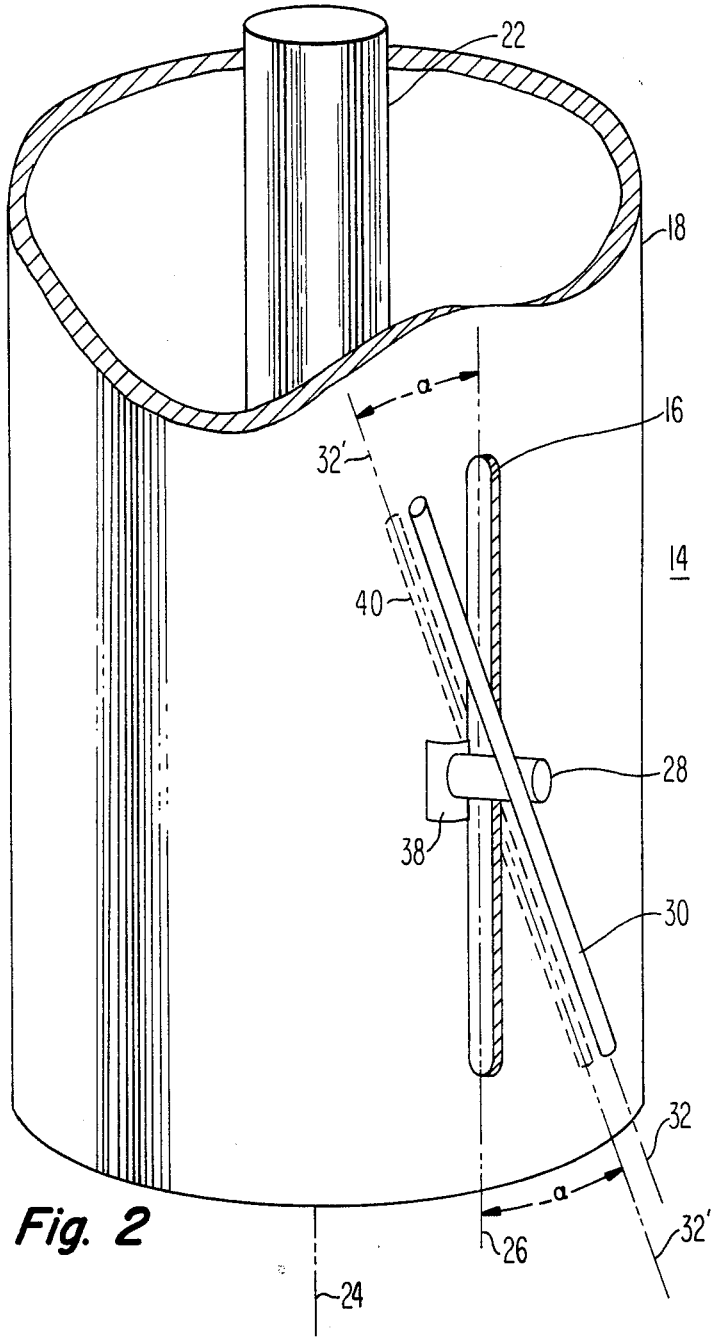
FIG. 2 illustrates in perspective view a portion of an antenna bay in accordance with the invention, and including a coaxial transmission line, a slot and a parasitic radiator.

FIG. 2 illustrates bay 14 in more detail. In FIG. 2, slot 16 cut into outer conductor 18 can be seen more clearly. Slot 16 lies along outer conductor 18 parallel to central axis 24. Parasitic radiator 30 passes through a hole in dielectric support cylinder 28 and is supported in a position away from the outer surface of outer conductor 18. Dielectric support 28 is in turn mounted upon and supported by a mounting arrangement 38 described in greater detail in conjunction with FIG. 7.

Figure 10:
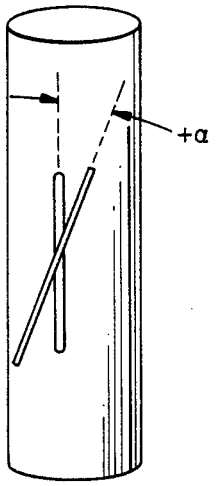

Also illustrated in FIG. 2 is the outline 40 of the projection onto outer conductor 18 of parasitic element 30. The projection is along a radial direction relative to the generally cylindrical structure of the coaxial transmission line (i.e., the projection is parallel to a radial line extending perpendicularly from axis 24 through the center of slot 16). For simplicity, the curvature of the projection due to the curvature of outer conductor 18 is not shown. The axis 32' of projection 40 also lies along outer conductor 18. The angle minus $\alpha(-\alpha)$ between axis 26 and axis 32' defines a deviation or skew angle between the axis 32 of parasitic element 30 and the axis 24, or between parasitic element 30 and the longitudinal direction of the slot. This angle is selected to be in the vicinity of 6°, for reasons described below. For the orientation of parasite 30 illustrated in FIGS. 1, 2 and 3, the angle $\alpha$ is negative. A positive angle $\alpha$ arrangement is illustrated in FIG. 10.

FIG. 3 illustrates three orthogonal projections of the bottom bay of the antenna illustrated in FIG. 1. The elements of the bay as illustrated in FIG. 3 have already been described in conjunction with FIGS. 1 and 2 except for a bolt flange 310 which is welded to the outer conductor 18 for allowing the antenna to be bolted in known fashion to a mating support flange at the top of the antenna tower support.

In order to produce circularly polarized radiation (or nominally circulary-polarized radiation, which is elliptical polarization with low axial ratio), two orthogonally polarized vectors or fields must be generated which are equal in amplitude, and which are in phase quadrature. The first of the two orthogonal vectors is the horizontally-polarized vector produced by direct radiation from the slot. While ordinarily described as radiation "from a slot", the slot actually excites the surrounding conductive surface, and it is the outer conductor or mast itself which carries current and which radiates. Thus the first or horizontally-polarized vector is radiated due to excitation of the mast by the slot. The second of the vectors is the summation of the vertical component of the field reradiated by parasitic radiator 30 and the vertically polarized field component reflected or re-radiated by outer conductor 18 as a result of radiation from parasitic element 30.

As can be seen in FIG. 2, parasitic element 30 overlies essentially the same portion of outer conductor 18 into which axial slot 16 is cut. The slot excites the mast with currents giving rise to horizontally-polarized radiation, and the parasite excites the mast with currents giving rise to vertically-polarized radiation. Because of the similarity in size and positioning of the slot and the parasite relative to the outer conductor, it is reasonable to believe that if the magnitudes of the signals induced into the mast are the same, the mast radiation of the vertical and horizontal components will be the same, except for those boundary conditions of mast current which depend upon the direction of current flow. The magnitudes of the vertical and horizontal fields can be substantially equal if the coupling factor between the parasitic element and the slot approaches unity. A near-unity coupling factor is achieved at a radial separation distance between parasitic element 30 and slot 16 which is approximately 0.1 wavelength. This results from the fact that the summation of mutual impedances at this separation approaches the actual driving point impedance of the parasitic element, the real part of which is zero ohms. Thus, the magnitudes of the horizontal and reradiated vertical fields are substantially equal.

In order to achieve circular polarization the vertical and horizontal field components must be in phase quadrature. Phase variation between the directly-radiated horizontal and reradiated vertical components of the field results from the reactance of the parasitic element. As known, the reactance is a function of the length of the parasitic element. By adjustment of parasitic length, therefore, the phase of the reradiation from the parasitic element and the mast relative to the radiation from the slot can be controlled. With the parasitic radiator positioned for negative $\alpha$ angles as illustrated in FIGS. 1, 2, and 3, the far-field radiation pattern will be left-hand circular (as defined according to IRE Standards on Radio Wave Propagation, 1942, Supplement to Proceedings of the IRE, 30, No. 7, Part III, referred to at page 471 of "Antennas" by Kerns, McGraw Hill 1950). For positive values of acute angle $\alpha$, the principal radiation field is right-hand circularly polarized. Thus, the hand or direction of polarization, the magnitude of the two orthogonal field vectors and the phase therebetween can be established using as control parameters the orientation of parasitic element 30, the parasite angle $\alpha$ and the length of the parasitic element. Small variations in the λ/10 separation between the slot and the parasite do not significantly affect the phase.

The effect of changing angle alpha can be explained as follows. If $\alpha$ is small or zero, parasitic element 30 has no length component parallel to the horizontally-polarized field of slot 16. Consequently, there is no coupling of energy into parasite 30 and no vertically-polarized radiation. The sum field is then horizontally polarized.

As $\alpha$ is increased to about 6°, the amount of energy coupled into the parasite and reradiated increases, but $\alpha$ is small enough so that most of the reradiated power goes into vertical polarization and very little into horizontal polarization (the magnitude of the horizontally-polarized parasitic radiating component is proportional to sin $\alpha$; for values of $\alpha$ near 6°, sin $\alpha$ is about 0.1) As $\alpha$ increases well past 6°, more energy is coupled into the parasitic elelment, but proportionally more of that energy is reradiated as horizontal rather than as the desired vertical polarization. It can be understood from this discussion that values of $\alpha$ near but not equal to 6° may also provide the desired conditions for circularity.

As so far described, the conditions for circular polarization relate only to the conditions on the main beam of the radiation pattern i.e. at and near zero degrees (zero degrees corresponds with the aforementioned radial perpendicular to axis 24 and passing through the center of slot 16. The combination of the slot and dipole dipole-like parasitic elements is particularly advantageous, because it not only produces either circular polarization or nominal circular polarization on the main axis, but it also produces one of these conditions over a wide spatial angle of radiation and over a relatively wide frequency range. This results from the general similarity of the azimuth and elevation-direction radiation patterns of the slot in the conductive circular cylinder (the outer conductor of the coaxial feed line) and of the parasitic element, as mentioned previously. Furthermore, the frequency-dependency of the slot and of the parasitic element are substantially equal, and therefore the changes in radiation pattern as a function of frequency tend to track each other. This frequency tracking would occur even if the slot and parasite did not have mutual coupling therebetween, and the presence of tight coupling tends to cause the frequency characteristics to track closely.

The radiation patterns of FIGS. 4 and 5 were made at 819 MHz on an antenna similar to that of FIGS. 2 and 3 with the following dimensions:

| | |
|---|---|
| inner conductor diameter | 1.75 inch (4.45 cm) |
| outer conductor diameter | 6.5 inch (16.5 cm, 0.445λ) |
| slot length | 6.5 inch (16.5 cm) |
| slot width | 1.0 inch (2.54 cm) |
| parasite length | 6.14 inch (15.6 cm) |
| parasite diameter | 0.25 inch (6.4 mm) |
| parasite-to-mast separation (measured from center of parasite) | 1.0 inch (2.54 cm) |

Figure 4A:
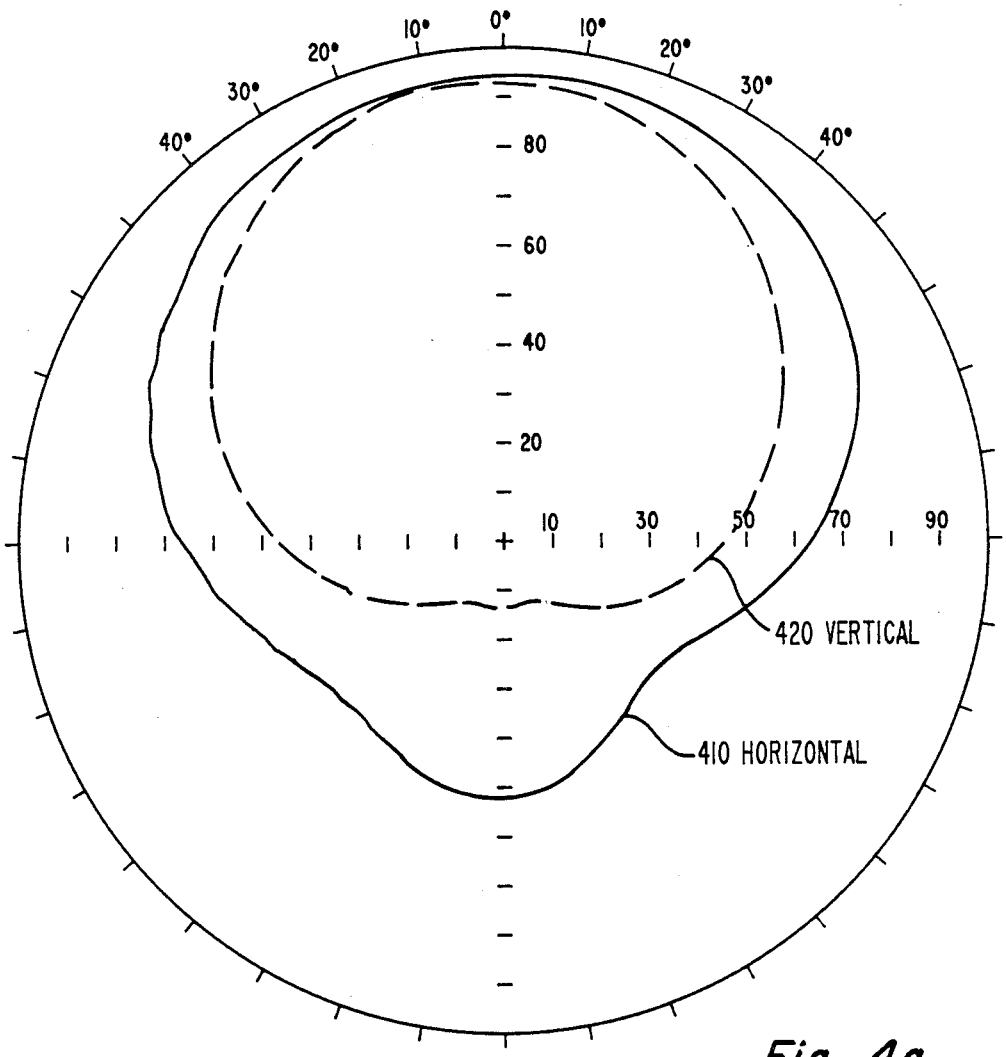
FIGS. 4*a* and 4*b* are linear-amplitude polar plots of linearly-polarized and axial-ratio azimuth-plane radiation patterns, respectively, of the antenna of FIG. 2.

In FIG. 4*a*, the dashed lines represent vertical polarization and the solid lines represent horizontal polarization. It can be seen that at zero degrees (measured with respect to the radial line perpendicular to the axis 24 and passing through the center of the slot) the vertical and horizontal polarization components of the radiated field are almost equal. The horizontal polarization azimuth plot 410 has a "skull" pattern typical of a slot-excited cylinder. The vertical-polarization pattern 420 is a cardioid-like directional pattern typical of a dipole (i.e., the reradiating parasite) near a cylindrical reflector (the mast). It should be noted that the magnitude of the vertically-polarized field 420 at 180° is finite, with a tendency towards nulls at 150° and 210°, roughly the same angles at which skull pattern 410 has nulls. Thus, the radiation patterns of FIG. 4*a* substantiate the theory that the boundary conditions for the slot-driven conductive cylinder and the parasite-near-cylinder are substantially equal.

Figure 4B:
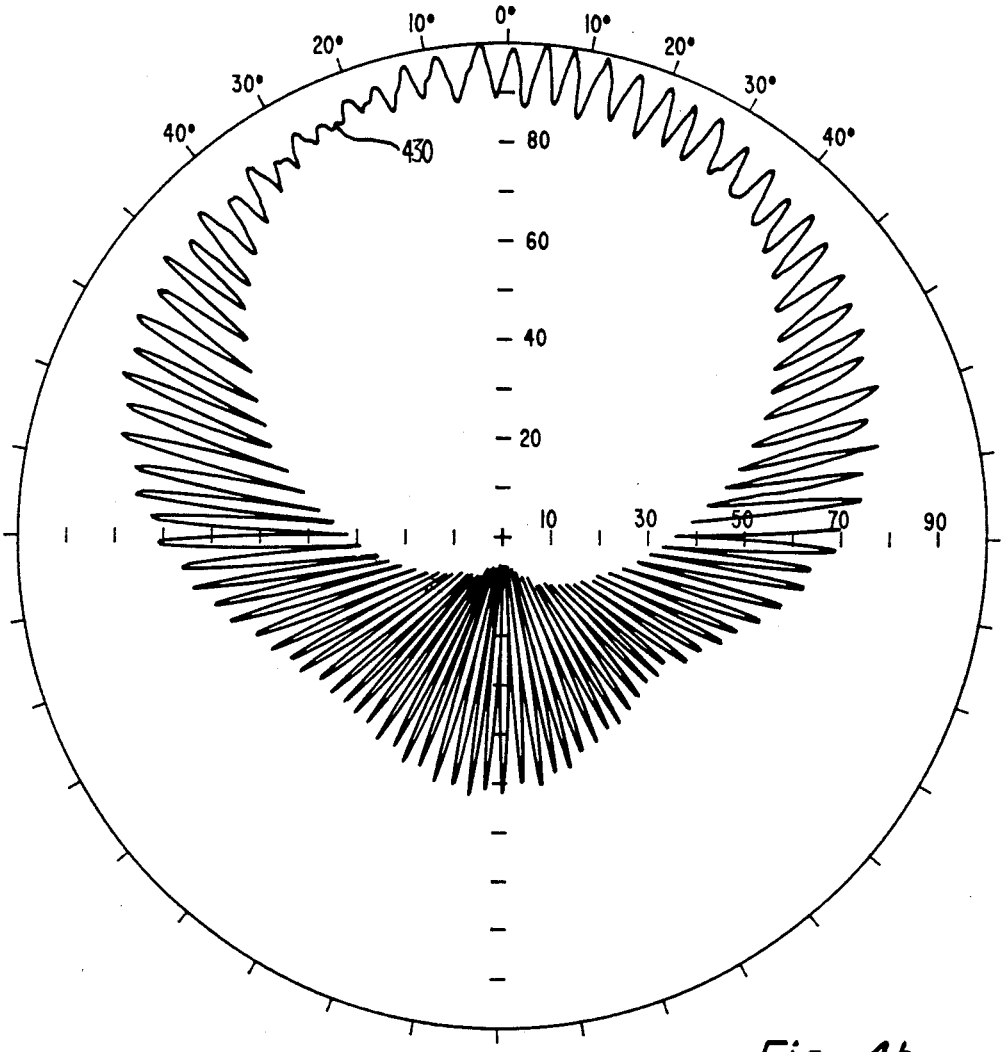

FIG. 4*b* illustrates an axial-ratio polar plot of a radiation pattern corresponding to the vertical and horizontal-polarization radiation pattern of FIG. 4. An axial-ratio pattern differs from a linear-polarization pattern in that a rotating linearly-polarized antenna is used for transmitting to (receiving from) the antenna under test. In FIG. 4*b*, it can be seen that the axial ratio approaches unity (zero dB) at a point 430 approximately 22° off-axis, to the left side as viewed in FIG. 4*b*. In order to determine the maximum axial-ratio within a particular spatial angle, say ±45° from 0° in the azimuth plane, as illustrated in FIG. 4*b*, note that at +45° the envelope of the maximum axial-ratio has a value of about 0.905 and the envelope of the minimum axial-ratio at +45° is 0.76. The corresponding axial ratio (A.R.) is $$\text{A.R. (dB)} = 10 \log_{10} \text{MAX/MIN}$$
$$\text{A.R. (dB)} = 10 \log_{10} 0.905/0.76$$
$$\text{A.R. (dB)} = 10 \log_{10} 1.2$$
$$\text{A.R. (dB)} = 10\,(.076) = .76 \text{ dB.}$$

A similar calculation for the −45° angle yields an A.R. of 0.86 dB. Other values of A.R. within the range of ±45° are smaller in magnitude, hence the maximum A.R. in the ±45° spatial angle is 0.86 dB. This is a very low axial-ratio, and higher values are acceptable for broadcast use. Thus, the useful azimuth coverage illustrated in FIG. 4 may be as much as 180°.

Figure 5A:
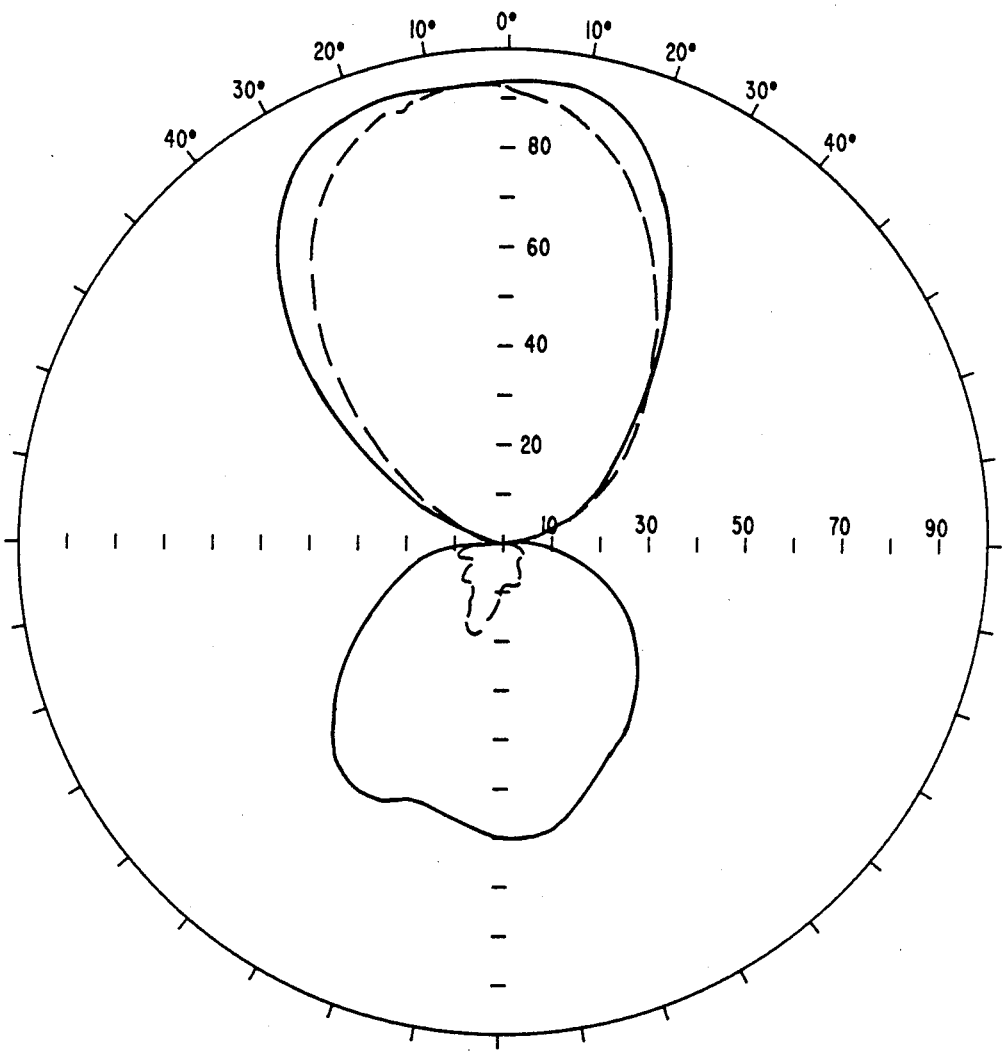
FIGS. 5*a* and 5*b* are linear-amplitude polar plots of linearly-polarized and axial-ratio elevation-plane radiation pattern, respectively, of the antenna of FIG. 2.
Figure 5B:
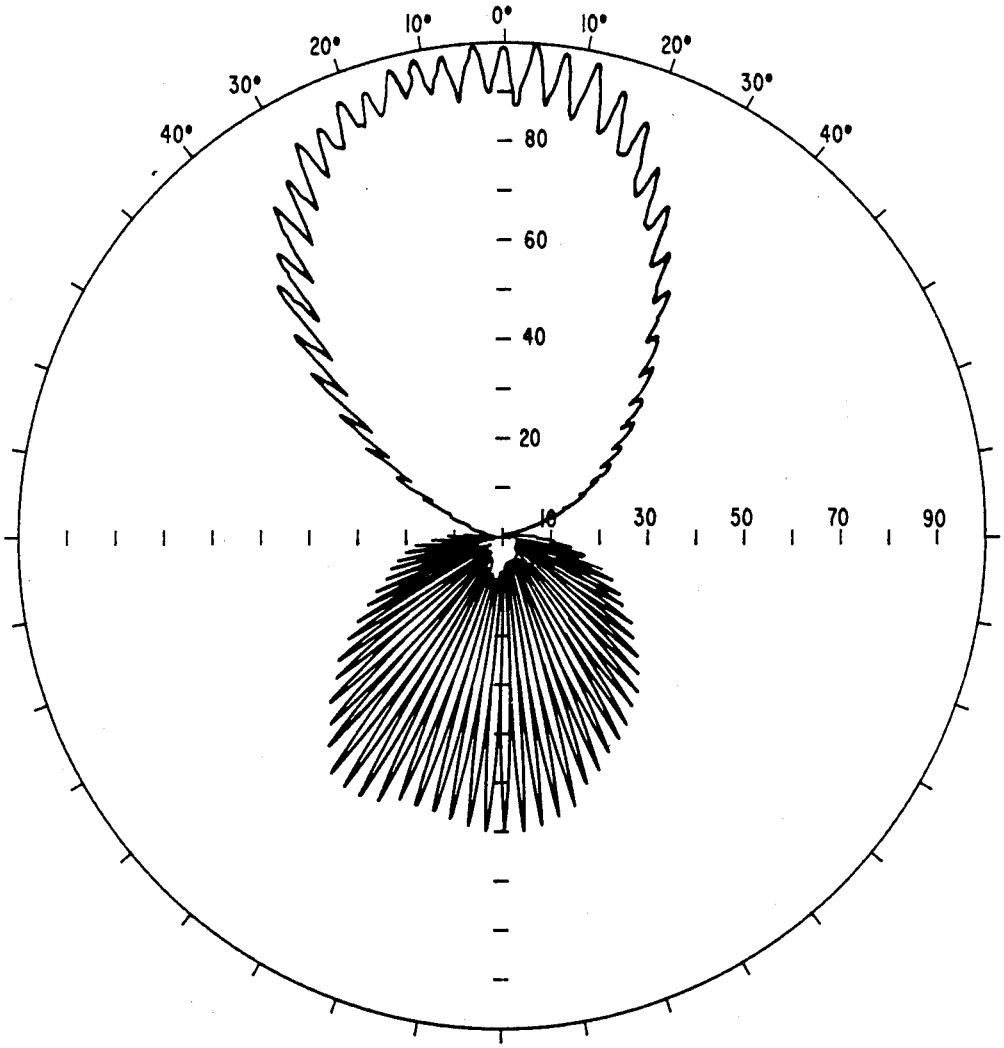

FIG. 5*a* is a linear polar plot of elevation-plane vertical and horizontal components of the radiation field. FIG. 5*b* is a axial-ratio polar plot in the elevation plane passing through the 0° axis. The maximum axial ratio calculated as described previously in the range of ±45° generally does not exceed 0.8 dB. Consequently, it may be inferred that over a 90° conical angle, the axial ratio does not exceed about 0.8 dB.

As so far described, the slot-parasite configuration of the present invention has further advantages over the slot-loop arrangement of U.S. Pat. No. 3,340,534 to Fee. Fee's loop extends about 0.3λ above the conductive surface of the transmission line, by comparison with about 0.1λ for the linear parasitic element. Windloading forces increase as the square of the distance projected, so the forces on a loop will tend to be much greater than the forces on a similar-diameter linear parasite. The wind loading is even greater in Fee's arrangement, since the current-handling requirements of a loop require large-diameter conductors; the linear parasitic element has relatively low currents and need not be so large. Further, the loop has conductive portions projecting radially from the surface of the trasmission-line, and these portions carry large currents which radiate in undesired polarizations and directions, thereby reducing the useful gain of the antenna and perturbing the radiation pattern.

Figure 6:
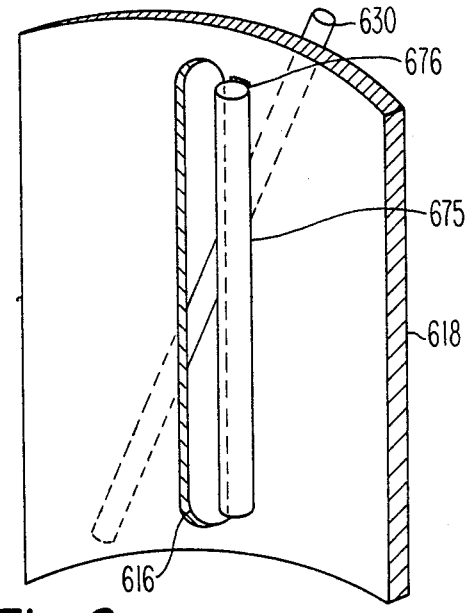
FIG. 6 illustrates details of a slot coupling mechanism as viewed from within the transmission-line.

While various coupling arrangements are possible for coupling energy from the TEM wave within the coaxial transmission line, a particular form of coupling element is illustrated in FIG. 6. In FIG. 6, a section 616 of outer conductor 618 is illustrated together with a slot 616 cut therethrough. Since the view is from inside the coaxial line, only a portion 630 of parasitic element 30 is visible. For simplicity, support 28 is not illustrated. A conductive coupling rod illustrated as 675 is welded adjacent to slot 616 by a weld 676 for coupling signal from the coaxial transmission line to the slot. The amount of coupling is determined by the diameter and length of coupler 675. The coupler for the slot of the antenna used to generate the radiation patterns of FIGS. 4 and 5 used a bar coupler having a length of 7.29 inches (18.5 cm) and a diameter of 1.125 inch (2.83 cm) centered alongside the slot.

FIGS. *7a* and *7b* illustrate in perspective and sectional views a mounting arrangement for the parasitic element which allows easy adjustment of the angle $\alpha$ at which parasitic element is oriented. In FIG. 7, a bracket 710 supports parasitic element 730 at an $\alpha$ angle of about 0°. Bracket 710 has a portion 708 which is flat and which bears against outer conductor 718, and a portion 706 at an angle to portion 708. A dielectric rod 728 is fastened to portion 706 of bracket 710 by a screw 707 threaded into the base of rod 728. Rod 728 may be made from any one of a number of materials such as polytetrafluoroethylene (TEFLON) which are transparent to radio-frequency signals. The center of parasitic element 730 (only a portion of which is shown in FIG. *7a*) passes through a hole 729 bored through rod 728 near the end of the rod. Parasite 730 may be held in place in hole 729 by adhesive, by a locking screw 731 threaded into the end of rod 728 and bearing against parasite 730, or by other means. A blot 750 is threaded through a threaded hole 704 formed in outer conductor 718 and locked in place by means of a lockwasher 703, effectively forming a threaded stud on the outside of outer conductor 718. Bracket 710 is mounted on the threaded end of screw 750 for rotation about axis 705. As bracket 710 is rotated, parasite 730 tilts, and small changes in angle $\alpha$ can be made without material change in the position of parasite 730 before slot 716. When the correct position is achieved, a nut 752 is tightened onto the protruding end of bolt 750 to fasten the bracket into the desired position.

Figure 8:
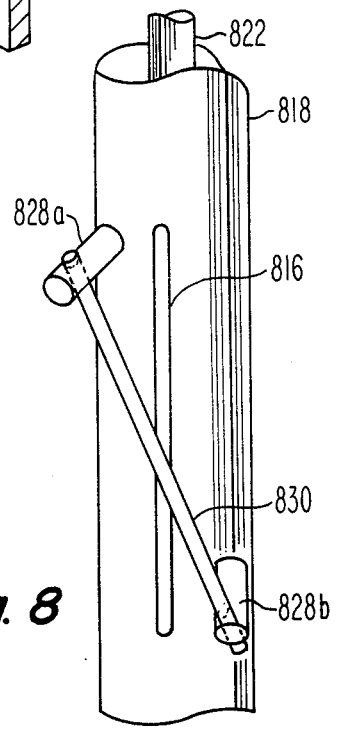
FIGS. 8 and 9 illustrate end-mounting of straight and curved parasitic elements, respectively, and FIG. 10 defines a sign convention.

FIG. 8 illustrates a linear parasitic element 830 supported at its ends by nonconductive support members 828*a* and 828*b*. This support may reduce any tendency of the tips of parasitic element 830 to vibrate under windload. However, the voltages associated with the parasitic element are at a maximum near the ends, and for very high power applications it may be found that the voltage stress tends to cause breakdown of the dielectric support.

Figure 9:
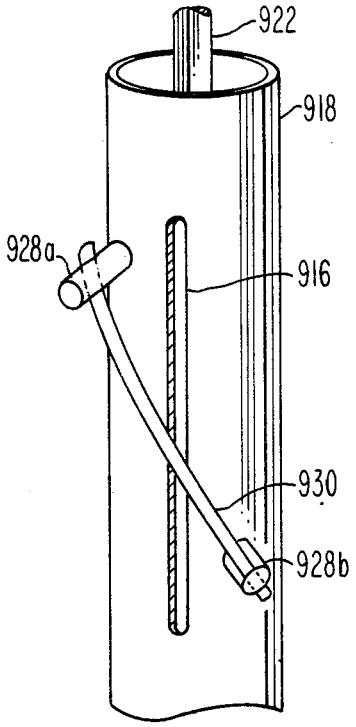

FIG. 9 illustrates an arrangement generally simlar to that of FIG. 8, except that parasitic element 930 is curved so as to be substantially equidistant from the surface of outer conductor 918. The projection of this parasitic element in frontal view is a straight line.

While the described embodiment of the invention uses a coaxial transmission line, pylon antennas driven from waveguide are known and may also be used with parasitic elements for circular polarization. Also, "dumbbell" or other slots having enlarged end portions as known may be used with the same effect as the slots illustrated having linear end portions. The ability to adjust the angle and length of the parasitic element is very important during the design phase of an antenna having a particular frequency, bandwidth, pattern, gain and impedance, but may be disadvantageous in the antenna as finally erected because of possible inadvertent misadjustment. Thus, the adjustable mounting bracket may for a field antenna be dispensed with. The end of the transmission-line remote from the feed (flange) end may be terminated as known by a matched termination or by a short-circuit. An individual dielectric radome may be used to cover each parasite-slot bay for environmental protection, as known.

What is claimed is:

1. An antenna, comprising:

a source of signal energy at a predetermined frequency;

straight elongated coaxial transmission-line means including an inner conductor and an outer conductor concentric about a first axis, said transmission-line means being coupled to said source of signal energy for receiving signal energy therefrom;

straight elongated slot radiating means formed in said outer conductor for coupling at least a portion of said signal energy from said coaxial transmission-line means and for generating a horizontally-polarized radiated field, said slot radiating means having a second axis, said second axis being parallel to said first axis of said straight elongated coaxial transmission-line means;

straight elongated conductive parasitic radiating means having a third axis;

mechanical mounting means mechanically coupled to said parasitic radiating means and to said outer conductor for maintaining said parasitic radiating means in such a position that the projection of said third axis of said parasitic radiating means onto said outer conductor in a direction radially extending from said first axis forms a predetermined acute angle on said outer conductor with said second axis of said slot radiating means, said predetermined acute angle being preselected so that a portion of the energy of said horizontally polarized radiated field is coupled into said parasitic radiating means and reradiated by said parasitic radiating means with substantially vertical polarization to form a reradiated vertically-polarized field with a phase angle such that the summation of said horizontally-polarized radiated field and said reradiated vertically-polarized field creates an elliptically-polarized field with low axial ratio.

2. An antenna according to claim 1 wherein said predetermined angle is six degrees.

3. An antenna according to claim 1 wherein said mechanical mounting means supports the center of said straight elongated parasitic radiating means at a radial distance from the outer surface of said outer conductor of about one-tenth wavelength at said predetermined frequency.

4. An antenna according to claim 3 wherein said predetermined angle is six degrees.

5. An antenna according to claim 1 wherein said parasitic radiating means has a length of about one-half wavelength and a diameter of about twenty-five thousandths of a wavelength at said predetermined frequency.

6. An antenna according to claim 5 wherein said predetermined angle is six degrees.

7. An antenna according to claim 1 further comprising slot coupling means coupled to said slot radiating means and to said coaxial transmission-line means for coupling said signal energy from said coaxial transmission-line means to said slot radiating means.

8. An antenna according to claim 7 wherein said slot coupling means comprises a conductive bar coupled adjacent said slot radiating means in a region between said inner and outer conductors.

9. A multiple-bay antenna for radiating a radiation pattern which is elliptically-polarized with low axial ratio, comprising:

an elongated transmission-line through which signal energy flows, said elongated transmission-line being oriented vertically and having a conductive outer surface; and a plurality of radiating antenna bays coupled to said transmission-line at vertically spaced positions thereon for coupling and radiating energy from said transmission-line, each of said bays including:

a vertically-oriented slot cut through said conductive outer surface, said vertically-oriented slot being approximately one-half wavelength long at a frequency of said signal energy, said slot having a first axis;

an elongated conductive parasitic radiating element having a length of about one-half wavelength at said frequency, and a diameter less than one-tenth said length, said parasitic radiating element having a second axis; and mounting means mechanically coupled to said conductive outer surface and to said parasitic radiating element for holding the center of said parasitic element in a position about one-tenth wavelength at said frequency from the center of said slot, and said second axis of said parasitic radiating element being angularly positioned with respect to said first axis by an angle of about six degrees in a plane orthogonal to a radial line passing orthogonally through said first axis at the center of said slot.

10. An antenna according to claim 9 wherein said mounting means comprises:

a bracket mounted upon said conductive outer surface for rotation about an axis radially disposed with respect to the axis of said transmission line;

a secondary support formed from a material which is nonconductive of electromagnetic waves at said frequency, said secondary support being mechanically coupled to said bracket and to said parasitic radiating element.

11. An antenna according to claim 9, wherein:

said elongated transmission-line is a coaxial transmission line.

12. An antenna according to claim 11 further comprising a bar coupler mechanically coupled to an inner side of said conductive outer surface immediately adjacent and parallel to said slot.

* * * * *